US009668929B2

(12) United States Patent
Patterson et al.

(10) Patent No.: US 9,668,929 B2
(45) Date of Patent: Jun. 6, 2017

(54) PATIENT TRANSFER DEVICE WITH DIFFERENTIAL BELT-TABLE SPEED CONTROL

(75) Inventors: Richard A. Patterson, Georgetown, TX (US); Ralph M. Smucker, Austin, TX (US)

(73) Assignee: ConMediSys, Inc., Austin, TX (US)

( * ) Notice: Subject to any disclaimer, the term of this patent is extended or adjusted under 35 U.S.C. 154(b) by 1613 days.

(21) Appl. No.: 12/901,298

(22) Filed: Oct. 8, 2010

(65) Prior Publication Data

US 2012/0084914 A1 Apr. 12, 2012

(51) Int. Cl.

| | |
|---|---|
| ***A61G 1/003*** | (2006.01) |
| ***A61G 7/00*** | (2006.01) |
| ***A61G 7/10*** | (2006.01) |
| *A61G 7/05* | (2006.01) |

(52) U.S. Cl.

CPC ..... *A61G 7/1032* (2013.01); *A61G 7/1046* (2013.01); *A61G 7/0507* (2013.01); *A61G 2200/16* (2013.01)

(58) Field of Classification Search

CPC .. A61G 7/1032; A61G 7/1046; A61G 7/0507; A61G 2200/16

USPC ..... 5/81.1 C, 81.1 R, 81.1 HS

See application file for complete search history.

(56) References Cited

U.S. PATENT DOCUMENTS

| | | | |
|---|---|---|---|
| 2,528,048 | A | 10/1950 | Gilleland |
| 3,418,670 | A | 12/1968 | Morgan |
| 3,593,351 | A | 7/1971 | Dove |
| 3,967,328 | A | 7/1976 | Cox |
| 4,087,873 | A | 5/1978 | Ohkawa |
| 4,631,761 | A | 12/1986 | Lederman |
| 4,669,137 | A | 6/1987 | Schnelle et al. |
| 4,761,841 | A | 8/1988 | Larsen |
| 4,794,655 | A | 1/1989 | Ooka et al. |
| 4,914,769 | A | 4/1990 | Kume et al. |
| 5,185,894 | A | 2/1993 | Bastert et al. |
| 5,428,851 | A | 7/1995 | Shore et al. |
| 5,540,321 | A | 7/1996 | Foster |
| 5,937,456 | A | 8/1999 | Norris |
| 6,698,041 | B2 | 3/2004 | VanSteenburg et al. |
| 6,857,143 | B2 | 2/2005 | McNulty |
| 6,932,209 | B2 | 8/2005 | Kasagami et al. |
| 7,200,881 | B2 | 4/2007 | Kasagami et al. |
| 7,484,252 | B2 | 2/2009 | Wang |
| 7,487,559 | B1 | 2/2009 | Denosky |
| 7,540,044 | B2 | 6/2009 | Patterson et al. |

(Continued)

*Primary Examiner* — David E Sosnowski

(74) *Attorney, Agent, or Firm* — Jack V. Musgrove

(57) ABSTRACT

A patient transfer device includes a table assembly having upper and lower tables with counter-rotating upper and lower belts. Means are provided to move the table assembly toward an extended position with the upper belt moving at a rotational speed which is greater than a translational speed of the table assembly. Faster movement of the upper belt may be in response to a determination that the patient has a characteristic whose value is within a predetermined range. The patient characteristic may be patient weight, e.g., with the predetermined range being less than 250 pounds. In the illustrative implementation a patient transfer device of the present invention includes a control system having a keyboard for receiving user input indicating that the upper belt should be moved faster, and control logic responsive to the user input which controls speeds of motors that independently drive the upper belt and the table assembly.

14 Claims, 5 Drawing Sheets

(56) References Cited

U.S. PATENT DOCUMENTS

| | | | |
|---|---|---|---|
| 7,603,729 | B2 | 10/2009 | Patterson |
| 2004/0244108 | A1 | 12/2004 | Spanton |
| 2008/0289101 | A1 | 11/2008 | Patterson et al. |

PATIENT TRANSFER DEVICE WITH DIFFERENTIAL BELT-TABLE SPEED CONTROL

BACKGROUND OF THE INVENTION

Field of the Invention

The present invention generally relates to devices for moving objects, and more specifically to a method and device for transferring mobility-impaired persons, such as moving a hospital patient from a bed to a table.

Description of the Related Art

A wide variety of products have been designed to move objects from one location to another and, in particular, transfer mobility-impaired individuals such as patients. In a hospital or other medical setting, patients must often be transported from their beds to an examination table or operating table, and back again. Basic devices for transferring patients include stretchers that are carried manually by two attendants, and gurneys that can more easily be handled by a single attendant. A typical gurney (British trolley) has an elongate patient-support surface, a frame or chassis structure for the patient-support surface, and wheels or casters that facilitate movement of the gurney.

One innovation in the field of patient-transfer devices is the use of two counter-rotating belts for the patient-support surface which creep under the patient to provide "frictionless" acquisition and delivery. An example of such a design is shown in U.S. Pat. No. 5,540,321 (Foster). The attendant manually rotates a crank to move the upper and lower belt trays under the patient while the belts counter-rotate. Once the patient is supported by the trays, the tray assembly is raised off the bed and the device can be rolled on casters to transport the patient.

The entire Foster device moves during use, either closer to the patient/bed during acquisition, or away from the patient/bed during delivery. The mechanism that drives this lateral movement is the forcible engagement of the lower belt against the bed. Because movement of the lower belt drives the lateral movement of the device, the relative belt speed (eversion rate for both belts) is the same as the lateral speed of the support structure. The matching belt speed is relative to the table assembly, so technically one side of a given belt (upper or lower) will be moving at twice the table speed from a fixed point of reference, and the other side of the given belt will have zero speed from the fixed point of reference.

This inherent matching of the belt speed and lateral device speed carries through to a variety of patient moving devices. For example, U.S. Pat. No. 6,932,209 (Kasagami et al.) illustrates a patient transfer device which is motorized rather than relying on manual actuation. Kasagami is not technically a gurney since it does not have a frame or chassis on wheels, and it is used to transfer a patient from a bed to a gurney, but it still operates on the principle of two counter-rotating belts to avoid slippage between the patient and the upper belt. As with Foster, the lateral movement of the Kasagami device is driven by the lower belt itself, and so the lateral movement speed again matches the rotational speed of both belts.

Another patient transfer device which utilizes the two counter-rotating belts is illustrated in U.S. Pat. No. 7,540,044 (Patterson et al.). One representation of the Patterson invention is shown in FIG. 1. Patient transfer device 10 is generally comprised of a table assembly 12, a slide assembly 14, a support structure or frame 16, a device base 18, wheels or casters 20, and a control keyboard 22. Table assembly 12 is mounted on horizontal slide assembly 14 affixed to frame 16 to provide lateral movement to/from the patient's bed during acquisition/delivery. Patterson also teaches synchronizing the belt and table speeds such that there is no shearing between the patient and the surface of the upper belt, or between the bed and the surface of the lower belt.

While the use of two counter-rotating belts to crawl under a patient greatly reduces frictional engagement which ideally eliminates skin shear for the patient, the prior art patient transfer devices can still create significant patient discomfort. The Foster device can be particularly jerky since it is manually driven without any speed control. The motor-driven Kasagami device improves in this regard, but does not always move evenly to/from the patient since it has no tracks or rails to guide the lateral movement, so multiple attendants may be required to help position the device in order to easily acquire the patient. The Patterson device further improves in this regard by using the slide assembly to keep the table assembly properly aligned and smoothly move under the patient, but even with the Patterson device some patients still have described an uncomfortable pushing sensation on the body.

In light of the foregoing, it would be desirable to devise an improved patient transfer device and transfer method which provided a more comfortable patient acquisition experience. It would be further advantageous if the device and method could adapt to patients having different characteristics such as weight.

SUMMARY OF THE INVENTION

It is therefore one object of the present invention to provide an improved patient transfer device.

It is another object of the present invention to provide such an improved patient transfer device which can more comfortably and safely acquire a patient for transfer.

It is yet another object of the present invention to provide such an improved patient transfer device having different acquisition modes to optimize patient comfort based on patient weight.

The foregoing objects are achieved in a method of transporting an object such as a patient by positioning a transfer device adjacent a support surface for the object, the transfer device having a base and a table assembly movable between a home position over the base and an extended position to a side of the base and the table assembly further having upper and lower tables with counter-rotating upper and lower belts, adjusting a height of the table assembly to a height of the support surface, and moving the table assembly toward the extended position to place the table assembly underneath the object but resting upon the support surface, while keeping the base stationary and with the upper belt moving at a rotational speed which is greater than a translational speed of the table assembly. The upper and lower tables are preferably in forcible contact while the belts are moving, and separated once the table assembly is in the extended position to lift the object above the support surface on the upper table while the lower table remains resting upon the support surface; the table assembly can then be moved back toward the home position while supporting the object on the upper table and keeping the upper and lower tables separated. The upper belt is preferably driven using the lower belt while the upper and lower tables are maintained in forcible contact. The faster movement of the belts may be in response to a determination that the patient has a characteristic whose value is within a predetermined range. The patient characteristic may for example be patient weight, e.g., with the predetermined range being less than about 250 pounds. In the illustrative implementation a patient transfer device of the present invention includes a control system having a control keyboard for receiving user input indicating that the belts should be moved faster, and control logic responsive to the user input which controls speeds of motors that independently drive the belts and the table assembly.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
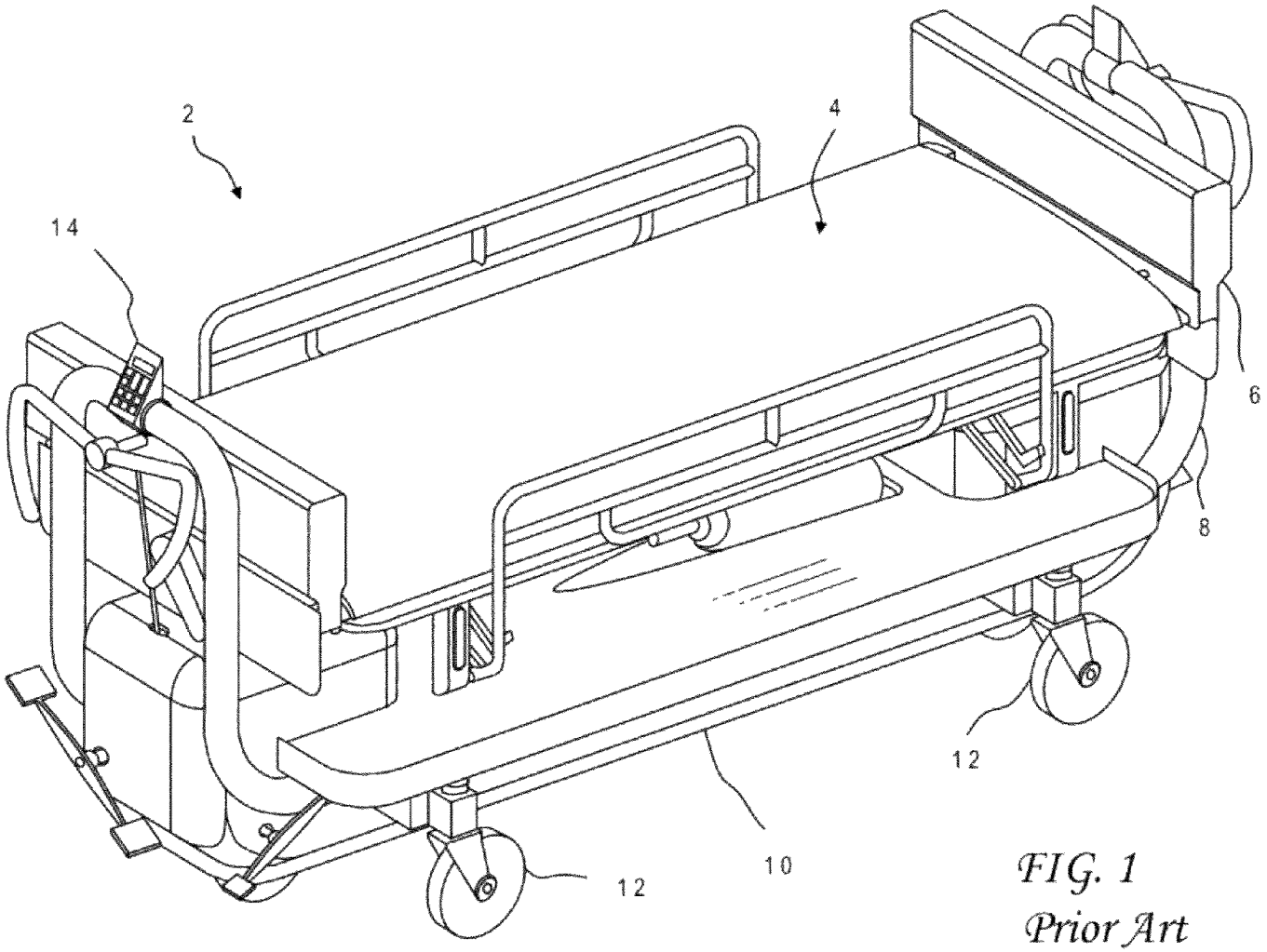
FIG. 1 Prior Art
FIG. 1 is a perspective view of a conventional patient transfer device.
Figure 2:
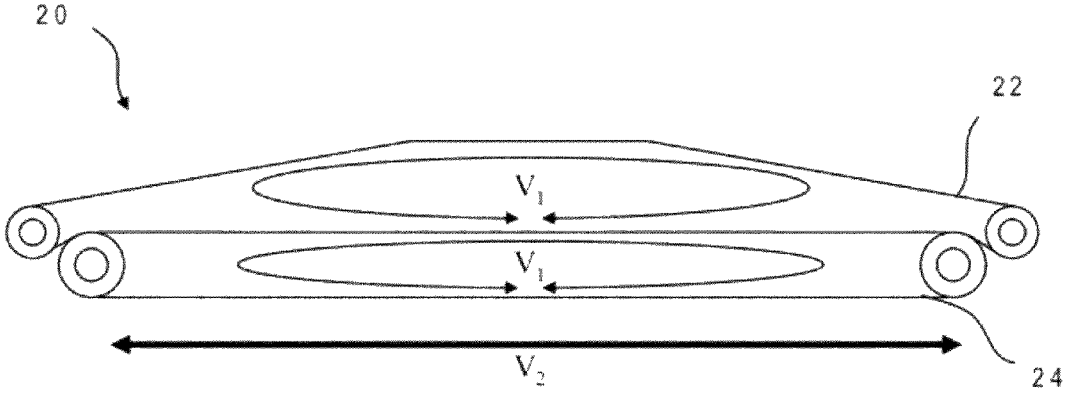
FIG. 2 is an elevational view of a table assembly for a patient transfer device having upper and lower counter-rotating belts which move at a speed that is different from a lateral speed of the table assembly in accordance with one implementation of the present invention.

With reference now to the figures, and in particular with reference to FIG. 2, there is depicted one embodiment 20 of a table assembly constructed in accordance with the present invention, used to acquire and deliver an object such as a patient. Table assembly 20 is generally comprised of an upper belt 22, and a lower belt 24. Details of the belt construction and support may include those features described in U.S. Patent Application Publication No. 2008/0289101, which is hereby incorporated. Those features may further include a slide assembly similar to that illustrated in FIG. 1 which is mounted to a wheeled base and which allows lateral movement of the entire table assembly 20 with respect to the base, while the base remains in a fixed position on the floor, for either patient acquisition or delivery.

In a preferred embodiment, upper and lower belts 22, 24 can be in either an engaged position or a disengaged position. In the engaged position, portions of upper and lower belts 22, 24 are in forcible contact, so driving one belt results in movement of the other. In a preferred embodiment the belt drive mechanism is located within and drives lower belt 24, so lower belt 24 in turn drives upper belt 22 when the belts are in the engaged position. In the disengaged position, lower belt 24 can rotate without driving upper belt 22. The disengagement may be achieved in various manners, such as physical separation of upper and lower belt tables or the retraction of internal drive rollers.

When the belts are engaged, driving lower belt 24 at speed $V_1$ will cause upper belt 22 to also rotate generally at speed $V_1$. However, table assembly 20 can translate to the left or right at a different speed $V_2$ (while the base of the transfer device remains fixed). In particular, the present invention provides for a belt rotation/eversion speed $V_1$ which is greater than the lateral table assembly speed $V_2$. For a preferred embodiment, this belt-table speed differential is only implemented during patient acquisition, i.e., $V_1>V_2$ for patient acquisition (on either side of the patient transfer device) while $V_1 \approx V_2$ for patient delivery. It has been found that this belt-table speed differential mitigates the uncomfortable pushing sensation that patients sometimes feel against their body during acquisition as explained further below.

Figure 3:
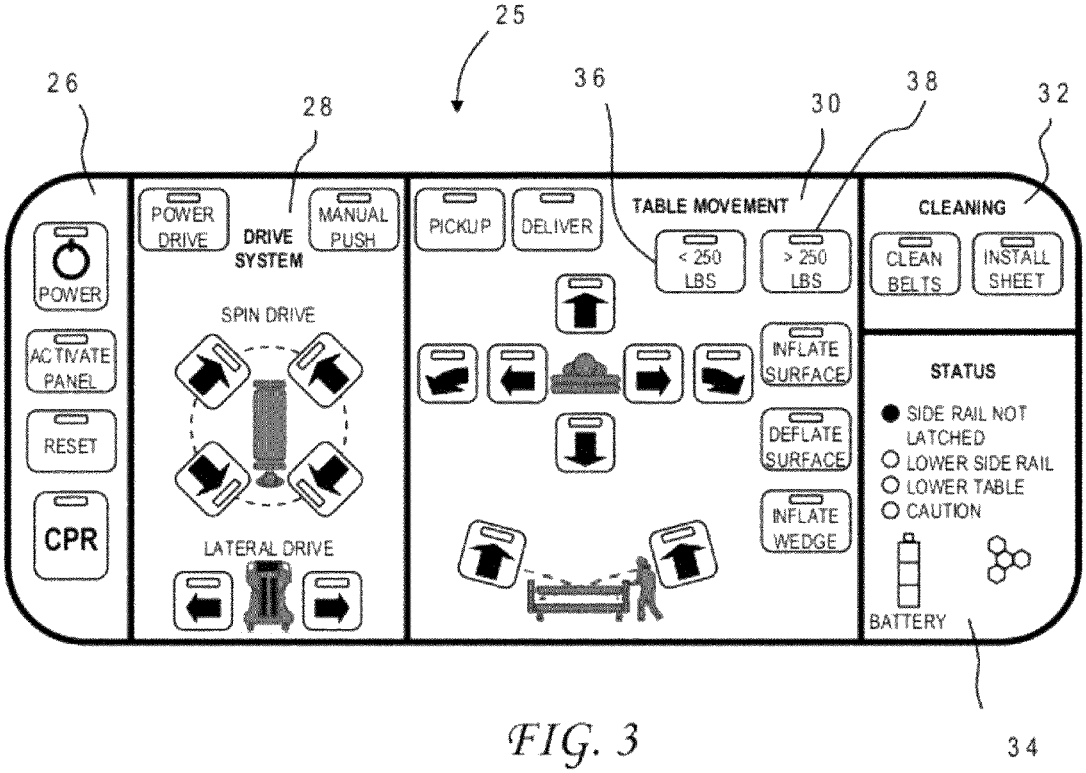
FIG. 3 is a plan view of one embodiment of a control keyboard for a patient transfer device in accordance with the present invention.

Depicted in FIG. 3 is a control keyboard 25 which an operator can use to control various aspects of a patient transfer device according to one embodiment of the invention. This exemplary control keyboard 25 is composed of a primary control panel 26, drive system panel 28, table movement panel 30, cleaning panel 32, and status panel 34. Primary control panel 26 may include a master Power key or button which can disconnect all electricity to the powered components of the transfer device, and may further include an Active Panel button to activate or deactivate other control buttons in the drive system and table movement panels, and a reset button which resets the control logic for the transfer device. Primary control panel 26 may also include an emergency button such as a cardiopulmonary resuscitation (CPR) alert. Movement controls for the patient transfer device (i.e., movement of the wheeled base) are located in drive system panel 28, and may include power drive mode or manual push mode buttons, spin drive buttons, and lateral drive buttons. Movement controls for table assembly 20 are located in table movement panel 30, and may include pick-up mode and deliver mode buttons, air mattress control buttons (inflate surface, deflate surface, and inflate wedge), vertical movement buttons (up and down), horizontal movement buttons (left and right), inclination buttons (left and right), and transportation buttons (left and right). Cleaning panel 32 is used in the cleaning of table assembly 20 and surrounding components of the patient transfer device, and may include a belt cleaning mode button and a sheet installation mode button. Status panel 34 shows one or more conditions of the patient transfer device, and may include an internal battery charge meter and visual indicators (e.g., light-emitting diodes) for warnings or tips such as "side rail not latched", "lower side rail", "lower table", and "caution".

According to a preferred embodiment of the present invention, table movement panel 30 further includes two patient weight buttons 36, 38. These two buttons allow the patient transfer device to operate in one of two modes, a first of these modes providing a belt speed which is greater than the lateral table speed ($V_1>V_2$), and a second of these modes providing a belt speed which is approximately equal to the lateral table speed ($V_1 \approx V_2$). In this example the weight threshold is 250 pounds, so button 36 is pushed for lower weight patients (less than 250 pounds), and button 38 is pushed for higher weight patients (greater than 250 pounds).

The specific weight threshold of 250 pounds for the two different weight modes is deemed preferable based on testing, but should not be considered in a limiting manner since other arbitrary weight thresholds may be used, in particular with varying speed differentials as explained further below. For example, the weight threshold could alternatively be 200 pounds, or three different weight modes could be provided for (i) less than 150 pounds, (ii) 150 pounds to 250 pounds, and (iii) greater than 250 pounds. In a further alternative embodiment, the response of the transfer device to patient weight may be generally continuous, i.e., a range of speed differentials over a weight range of 75 pounds to 500 pounds. The approximate nature of the weight threshold is also reflected in the weight selection buttons 36, 38 which indicate "greater than" or "less than", but not "equal to". If a patient happens to weigh exactly 250 pounds then the operator can use either button 36, 38 in her discretion. The invention can also be implemented without weight considerations, i.e., always providing a slightly higher belt speed for acquisition regardless of patient weight.

It has been discovered that, in the case of a patient weighing less than about 250 pounds (and especially if less than about 130 pounds), when the belt table assembly is extended at the same rate as the belt speed, there can be a somewhat uncomfortable pushing sensation on the body. This sensation is possibly due to the fact that there is less "cushion" between the musculoskeletal structure and the patient's skin surface. In lighter weight patients, if the rotational speed of the belt is significantly greater than the translational speed (e.g., $V_1 \approx [110\% \times V_2, 130\% \times V_2]$), this pushing effect is mitigated by a lifting sensation as the belt table comes into contact with the patient. Lighter-weight test subjects reported a much more comfortable experience with the speed differential of the present invention which creates a lifting effect and minimizes if not eliminates the pushing sensation on the patient. For a patient weighing more than 250 pounds there is usually a substantial cushion between the skin and the musculoskeletal structure, and these patients do not seem to receive the same benefit that lighter patients receive from the rotational/translational speed differential. The benefit appears to become insignificant at patient weights of around 500 pounds.

The qualitative relationship implemented by the present invention is generally increased belt-table speed differential for lower weight, i.e., the speed differential is generally an inversely proportional function of patient weight. A very heavy person requires little or no speed differential, while a very light person can benefit more from an increased speed differential. In an exemplary embodiment, the lateral table assembly speed is around 8-10 feet/minute, and the belt speed is about 5%-20% greater than the table speed for acquisition of lighter weight patients (less than around 250 pounds), most preferably about 10% greater.

Those skilled in the art will appreciate that, since it is only the upper belt that comes into contact with the patient during acquisition (not the lower belt), the present invention further contemplates embodiments wherein the upper and lower belts move at different speeds, for example, the lower belt moving at the same speed as the table assembly and only the upper belt moving faster than the table assembly, with slippage allowed between any adjacent portions of the upper and lower belts. Such an embodiment may provide independent drive mechanisms for the upper and lower belts.

Figure 4:
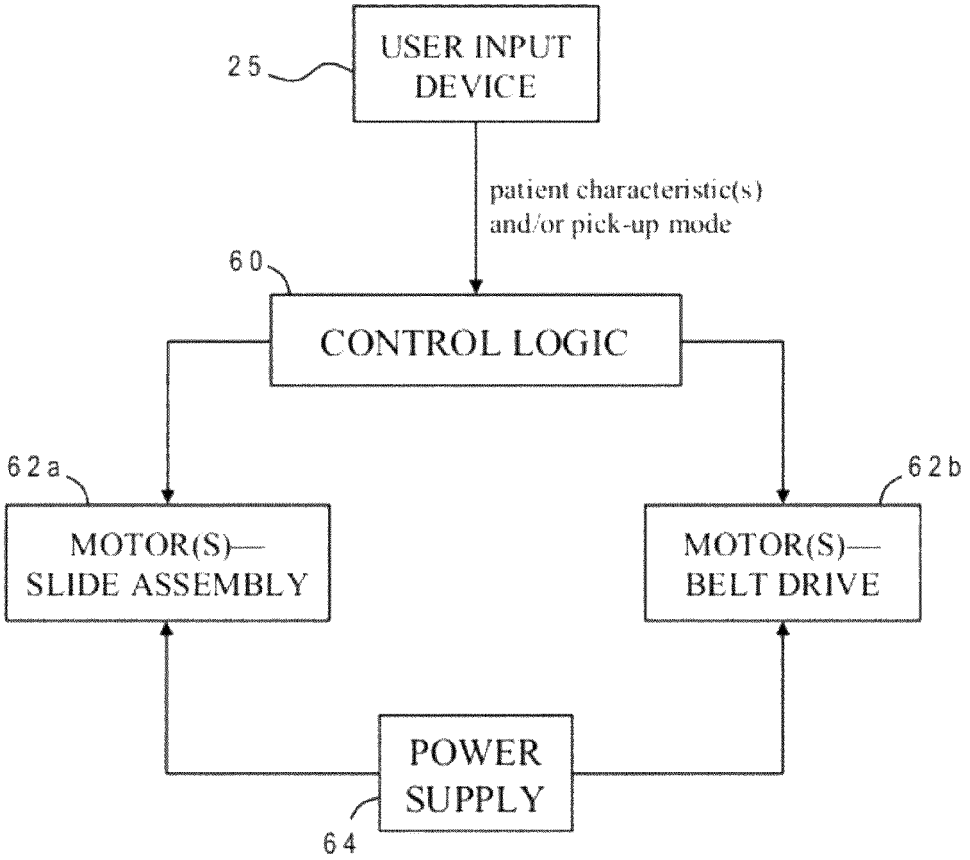
FIG. 4 is a high-level schematic diagram illustrating components of the electric motor system for one embodiment of the present invention.

Electric motors can be used to separately drive the belts and the table assembly as shown schematically in FIG. 4. As noted above, in the illustrative embodiment upper belt 22 is driven while in the engaged position from the movement of lower belt 24. Lower belt 24 can be driven by two drive rollers mounted to the internal framework of the lower belt table which are rotated by small-diameter planetary gear electric motors 62*b* that are also mounted to the internal framework. Table assembly 20 can be moved laterally by driving the supporting slide assemblies at each end of the transfer device with respective drive chains coupled to a single cross-shaft that extends generally the length of the patient transfer device, underneath table assembly 20. The cross-shaft is driven by another electric motor 62*a* with an integral gear box. The electric motors are responsive to an electronic control system which can selectively instruct the motors to rotate at various speeds either clockwise or counterclockwise. Control logic 60 of the electronic control system can be used to carry out the various speed functions described herein. Control logic 60 can receive information from a user input device (e.g., control keyboard 25) such as patient characteristics and/or an indication of a patient acquisition (pick-up) mode. Control logic 60 may be implemented as an application-specific integrated circuit (ASIC), a microcontroller, or other digital computational device including more intelligent computer systems. An on-board power supply 64 can be provided, e.g., one or more rechargeable batteries. Although the preferred embodiment uses independent motors to drive the belts and the slide assembly, the invention could be practiced using a single motor with adjustable linkages, gears, cams, etc., to mechanically couple the single motor to the belts and the slide assembly. In further alternative designs, the belts and/or table assembly may be driven by one or more motors external to the transfer device but which can be releasably coupled to an internal drive chain.

Figure 5:
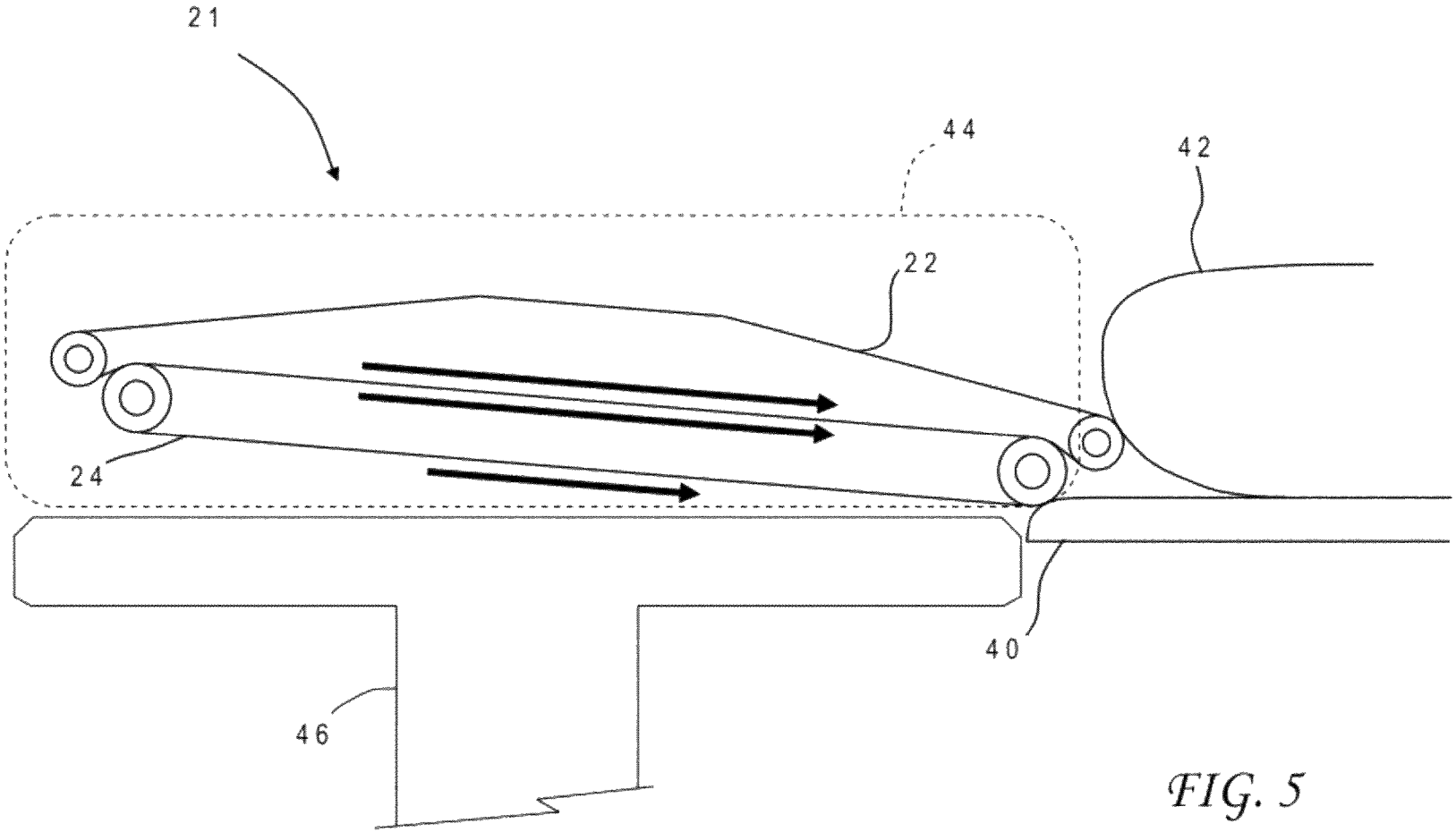
FIG. 5 is an elevational view of the table assembly of FIG. 2 illustrating acquisition of a patient or other object from a support surface using different speeds for the belts and table assembly in accordance with one implementation of the present invention.

FIG. 5 illustrates acquisition of a lighter weight patient 42 from a support surface 40 such as a bed using a patient transfer device 21 constructed in accordance with one embodiment of the present invention. Table assembly 20 may be optionally tilted slightly down and toward the patient for acquisition. This orientation is particularly useful when acquiring a patient on a mattress whose surface is depressed lower than the leading edge plane of the mattress (due to patient weight, a soft mattress, etc.) that might make it more difficult to properly place the leading edge of the table assembly between the mattress and the patient. Table assembly 20 moves laterally in a downward position toward patient 42 with slide assembly 44 while base 46 of patient transfer device 21 remains fixed. Simultaneously, upper and lower belts 22, 24 rotate with the contacting portions moving toward the patient at a speed greater than that of table assembly 20. The leading edge of upper belt 22 begins to contact and lift patient 42 while the leading edge of lower belt 24 begins to contact support surface 40 to provide lateral support for patient transfer device 21 and prevent it from tipping over as the patient weight becomes supported by the table assembly. The arrow illustrations in FIG. 5 represent relative vectors of the speeds of the belts and table assembly, i.e., the two longer arrows that are close are the speeds of the belts along their contacting surfaces and the shorter arrow near the bottom of the figure is the speed of the table assembly (the direction of movement of the bottom portion of lower belt 24 is away from the patient, opposite the table assembly movement).

The present invention may be further enhanced by selecting particular coefficients of friction ($\mu$) for the upper and lower belts. It is preferable to have a relatively higher for the belt surface contacting the patient so that the patient can be acquired without slippage, and to provide the noted lifting effect. It is also preferable to have a relatively lower $\mu$ for the belt surface contacting the bed or other patient support surface because the belt-table speed differential will tend to make the lower belt pull the bed surface or sheet, and a lower μ allows for more slippage. In the embodiment wherein movement of the lower belt drives the upper belt, the contacting surfaces should not be too slippery although a higher μ in the upper belt will allow for a lower μ in the lower belt. Consequently, in an illustrative embodiment the upper belt has a μ in the range of 0.5-0.8, while the lower belt has a μ in the range of 0.2-0.3. The belts may generally be made of any durable material, preferably a polymer such as polyvinyl chloride or polyurethane. The desired coefficient of friction may be achieved by the belt material formulation, surface treatment (texture), or a coating to impart a sticky or slippery surface. Suitable belts may be obtained from Habasit AG of Reinach, Switzerland (part numbers CMG-350-0048 and CMG-350-0061). If a disposable sheet or liner is used to cover the upper belt for sanitary reasons, it preferably has the same μ as the upper belt, e.g., 0.5-0.8.

Figure 6:
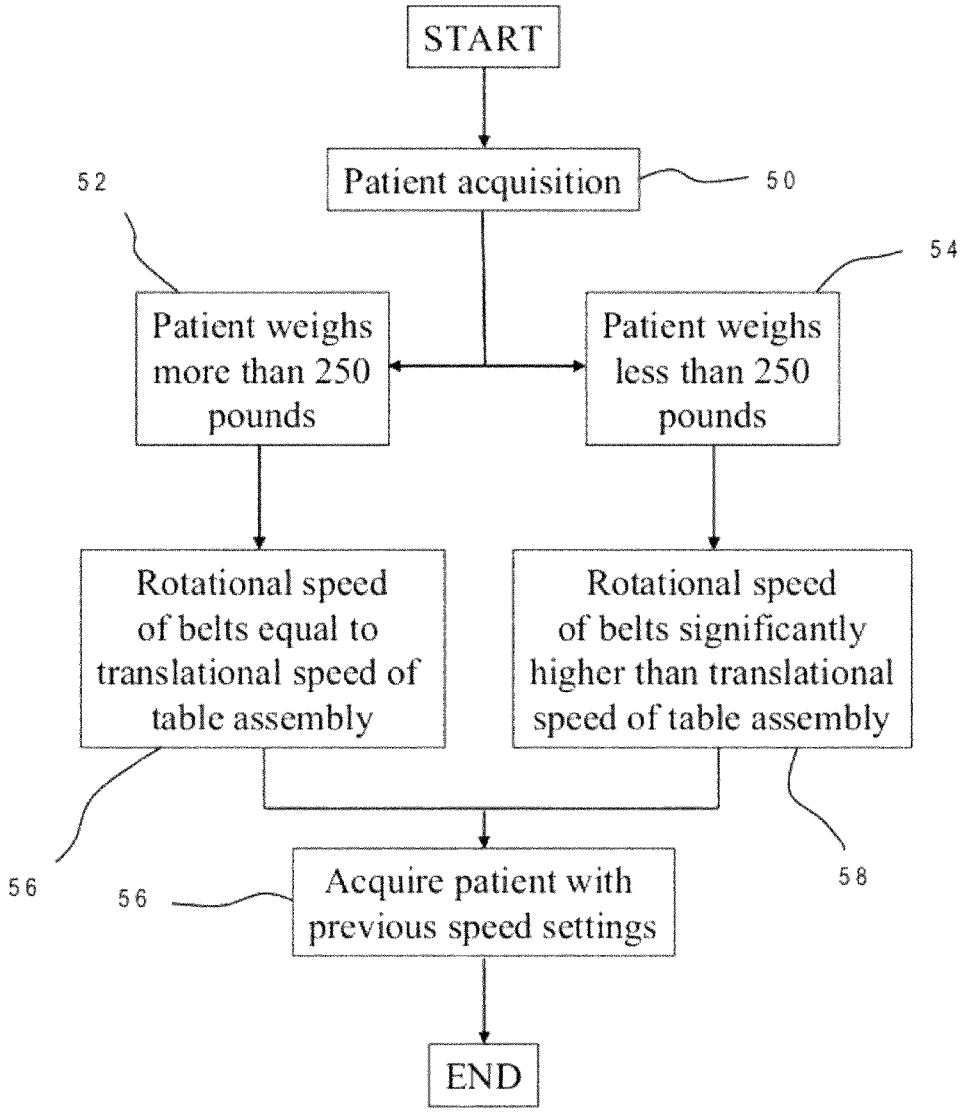
FIG. 6 is a chart illustrating the logical flow for patient acquisition using differential belt-table speed control in accordance with one implementation of the present invention.

The flowchart shown in FIG. 6 is one possible characterization of a process of acquiring a patient in accordance with the present invention. The process starts with a decision to acquire a patient for transfer (50) utilizing patient transfer device 21. Although patient acquisition is conveniently discussed in the context of transfer from a bed to an operating or examination table, the patient of course can be transferred from any type of support surface to any other type of support surface. The invention can also be practiced in the patient delivery process utilizing patient transfer device 21, but in the illustrative implementation it is used only for acquisition. The process then branches according to a patient characteristic. In this example the characteristic is patient weight, but other patient characteristics could be employed such as height or age. For a patient weighing more than (or around) 250 pounds, the process continues with box 52. For a patient weighing less than (or around) 250 pounds, the process continues with box 54. For the higher-weight patients, the rotational speed of the belts may be set approximately equal to the translational speed of the table assembly (56). For the lower-weight patients, the rotational speed of the belts may be set greater than the translational speed of the table assembly (58). While these speeds may be manually set by an operator using for example levers, linkages, gears, or other mechanical means, they are preferably set automatically by the motor system control logic in response to user selection of both patient weight (high or low) and patient acquisition (versus delivery) via control keyboard 25. While the illustrative embodiment contemplates user indication of patient weight, alternative embodiments can automate this decision by providing an estimate of the patient weight in a variety of manners. For example, a scale may be integrated into patient transfer device 21 to allow real-time weighing of the patient, or in another embodiment an on-board computer system having a wireless communication device (modem) can retrieve patient data which includes weight from a larger database system such as one maintained by a hospital or clinic and connected to a local area network or the Internet. The patient is then acquired using patient transfer device 21 at the previous speed settings (60), and the process is complete.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. For example, while the invention has been disclosed in the context of patient moving, it may also be used in mortuary settings or to transport inanimate objects. It is therefore contemplated that such modifications can be made without departing from the spirit or scope of the present invention as defined in the appended claims.

What is claimed is:

1. A method of transporting a patient, comprising:

positioning a transfer device adjacent a support surface for the patient, the transfer device having a base and a table assembly movable between a home position over the base and an extended position to a side of the base, the table assembly further having upper and lower tables with counter-rotating upper and lower belts;

adjusting a height of the table assembly to a height of the support surface;

determining that the patient has a characteristic whose value is within a predetermined range; and moving the table assembly toward the extended position to place the table assembly underneath the patient but resting upon the support surface, while keeping the base stationary and with the upper belt moving at a rotational speed which is greater than a translational speed of the table assembly in response to said determining.

2. The method of claim 1 wherein the upper and lower tables are in forcible contact during said moving, and further comprising:

separating the upper and lower tables with the table assembly in the extended position to lift the patient above the support surface on the upper table while the lower table remains resting upon the support surface; and moving the table assembly back toward the home position while supporting the patient on the upper table and keeping the upper and lower tables separated.

3. The method of claim 1 further comprising driving the upper belt using the lower belt while the upper and lower tables are maintained in forcible contact during said moving.

4. The method of claim 1 wherein the patient characteristic is patient weight.

5. The method of claim 4 wherein the predetermined range is less than about 250 pounds.

6. A transfer device for transferring a patient comprising:

a base having wheels;

at least one support member attached to said base;

a table assembly supported by said support member, said table assembly having upper and lower tables with counter-rotating upper and lower belts; and means for moving said table assembly toward the extended position with said upper belt moving at a rotational speed which is greater than a translational speed of said table assembly with respect to said base, wherein said moving means moves said upper belt at the rotational speed greater than the translational speed of the table assembly in response to both user selection of a patient acquisition mode and an indication that the patient has a characteristic whose value is within a predetermined range.

7. The transfer device of claim 6 wherein said upper and lower tables are separable and in forcible contact during said moving.

8. The transfer device of claim 6 wherein said upper belt is driven by said lower belt when said upper and lower tables are maintained in forcible contact.

9. The transfer device of claim 6 wherein the patient characteristic is patient weight.

10. The transfer device of claim 9 wherein the predetermined range is less than about 250 pounds.

11. A patient transfer device comprising:

a base having wheels;

at least one support member attached to said base;

a table assembly supported by said support member, said table assembly having upper and lower tables with counter-rotating upper and lower belts;

at least a first motor for driving movement of said table assembly toward an extended position;

at least a second motor for driving movement of said upper belt around said upper table;

a control system which selectively controls said first and second motors to move said upper belt at either a first rotational speed which is greater than a translational speed of said table assembly with respect to said base or a second rotational speed which is approximately equal to the translational speed of said table assembly, said control system including a control keyboard which receives at least one user input indicating that said upper belt should be moved at the first rotational speed which is greater than the translational speed of said table assembly, and control logic responsive to the user input which controls speeds of said first and second motors; and wherein the user input indicates a patient characteristic whose value is within a predetermined range.

12. The patient transfer device of claim 11 wherein the user input indicates a patient acquisition mode.

13. The patient transfer device of claim 11 wherein the patient characteristic is patient weight.

14. The patient transfer device of claim 13 wherein the predetermined range is less than about 250 pounds.

* * * * *